United States Patent [19]

Saum

[11] Patent Number: 4,700,978

[45] Date of Patent: Oct. 20, 1987

[54] FIREPLACE ASHES REMOVAL DEVICE

[76] Inventor: Jack Saum, 22609 Dog Bar Rd., Grass Valley, Calif. 95949

[21] Appl. No.: 911,516

[22] Filed: Sep. 25, 1986

[51] Int. Cl.[4] ..... A47F 13/08

[52] U.S. Cl. ..... 294/9; 294/55

[58] Field of Search ..... 294/9, 55, 10, 50.9, 294/50.8, 53.5, 49; 15/104.8, 257.1, 257.6, 257.7; 126/242, 243

[56] References Cited

U.S. PATENT DOCUMENTS

| | | | |
|---|---|---|---|
| 641,064 | 1/1900 | Anderson | 126/242 |
| 2,637,588 | 5/1953 | Burke | 294/55 |
| 4,381,761 | 5/1983 | Foxen | 294/9 |
| 4,536,023 | 8/1985 | Sutter | 294/9 |

*Primary Examiner*—James B. Marbert

*Attorney, Agent, or Firm*—Mark C. Jacobs

[57] ABSTRACT

A new wood stove and fireplace residue removal tool and temporary storage device having a shovel member nestable into a tubular structure which is closed at one end for the temporary disposition of ashes and other waste products from a fireplace. The device includes a shocker, for urging the ashes rearwardly from the shovel component to the storage component. An optional poker for stacking the fire may be removably secured to the device for ready access by the user. A handle to enhance portability especially when the device is warm may be disposed upon at least the storage component. The storage component can also have a one way flap, to prevent material already disposed within the storage compartment from escaping when the device is angularly tipped for the collection of additional waste materials.

15 Claims, 9 Drawing Figures

FIREPLACE ASHES REMOVAL DEVICE

FIELD OF INVENTION

This application relates to a device for removing hot or cold ashes from a fireplace or other controlled burning situation.

BACKGROUND OF THE INVENTION

People who find it necessary to use a wood stove for their source of heat and others who are able to enjoy the pleasure of using a fireplace, usually hate the chore of having to clean out the wood stove or fireplace finding it a very dusty procedure. Many tools and procedures have been developed for cleaning out the remaining ashes and partially charred wood segments from the wood stoves/fireplace however, none to date are relatively dust free. Customarily people use a long handled shovel, to remove these residues. Usually this is done after the fire has gone out, due to the inability to store warm residues. The ashes and smoldering embers can not be stored in a paper bag, nor in a plastic container, nor even in a metal container that houses other trash that is subject to combustion. Therefore people usually wait until the fire is out to clean out the fireplace.

On many occasions however this can be inconvenient, as the homeowner may need to use the woodstove/fireplace continuously, yet the residue from the combustion of such things as paper or cardboard boxes has built up a significant amount such that it is necessary to clean out the fireplace. Due to the possibility of fire outside of the fireplace this procedure can not be carried out.

A tool that has been used to clean out the fireplace is the shop vacuum. Here again due to the use of plastic flexible hose and plastic parts, it is necessary to wait till the fire has gone out completely in order to avoid possible incineration or at least damage to the elements of the vacuum cleaner.

There is therefore, a need for a combination device that can both clean out the residues from a fireplace, and at the same time provide temporary storage for these residues.

It is an object of this invention therefore to provide a shovel type device that has a storage means attached thereto for the cleansing of residues from the fireplace and the temporary disposition of same.

It is another object to provide a severable two component fireplace cleaning device one of which components is in the format of a shovel and the other is in the format of a storage means.

It is another object of this invention to provide a fireplace cleaning tool that is easy to use and which allows for the storage of fireplace waste products such that continuous use of the fireplace can take place.

Yet another object is to provide a fireplace cleaning tool that permits the removal and substantially dust free transfer of ashes and other debris from the fireplace to a temporary storage means.

A still further object is to provide a fireplace cleaning device that can be easily stored in the household by occupying a minimum amount of floor space.

Other objects of the invention will in part be obvious and will in part appear hereinafter.

The invention accordingly comprises the product possessing the features, properties and the relation of components which are exemplified in the following detailed disclosure, and the scope of the application of which will be indicated in the claims.

For a fuller understanding of the nature and objects of the invention, reference should be had to the following detailed description taken in connection with the accompanying drawings.

It is to be noted that with respect to the instant device the terms wood stove and fireplace can be used interchangably since the use of the instant device with either is the same.

SUMMARY OF THE INVENTION

A new wood stove and fireplace residue removal tool and temporary storage device having a shovel member nestable into a tubular structure which is closed at one end for the temporary disposition of ashes and other waste products from a fireplace. The device includes a shocker, for urging the ashes rearwardly from the shovel component to the storage component. An optional poker for stoking the fire may be removably secured to the device for ready access by the user. A handle to enhance portability especially when device is warm may be disposed upon at least the storage component.

The storage component can also have a one way flap, to prevent material already disposed within the storage component from escaping when the device is angularly tipped for the collection of additional waste materials.

DESCRIPTION OF THE PREFERRED EMBODIMENT

Figure 1:
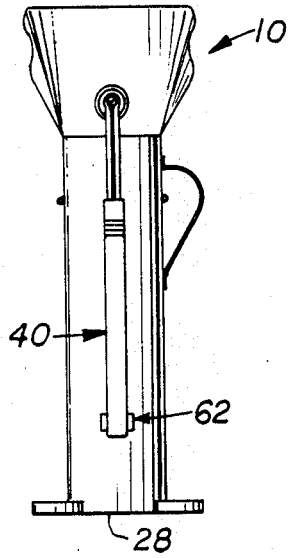
FIG. 1 is a rear elevational view of the device of this invention.

Device 10 is comprised of two portions, the shovel portion 11 and a container portion 12, each of which will be described in detail. Turning now to FIG. 1, there is seen a rear elevational view of the device of this invention. As is seen, the shovel portion has been nestably inserted into the container portion of the device.

Figure 2:
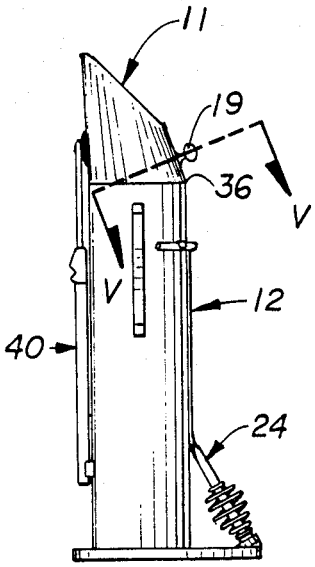
FIG. 2 is a left side elevational view thereof.
Figure 3:
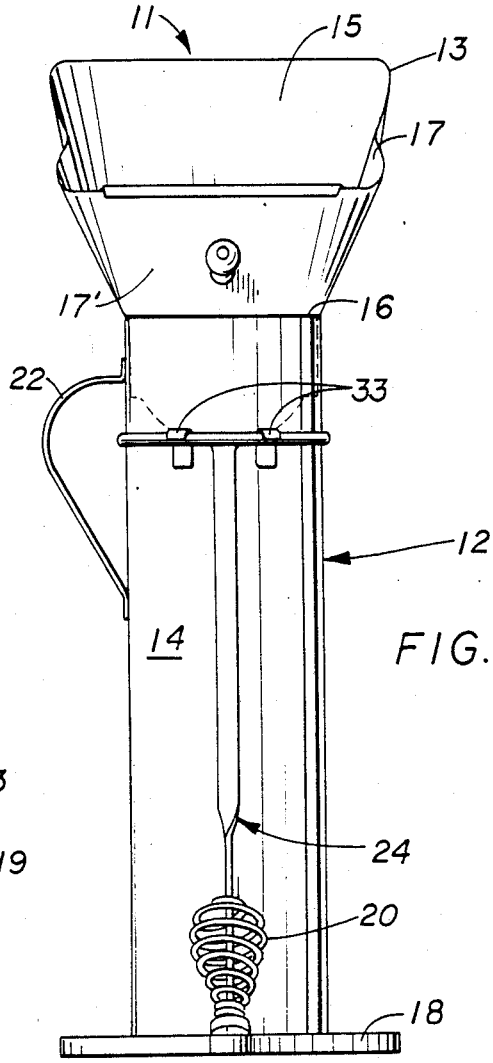
FIG. 3 is an enlarged front elevational view.

As seen in FIGS. 1, 2 and 3, the shovel portion 11 comprises a scoop shovel body 13 having a generally flat base 15 which for safety is blunted at its front edge and sides, and which may also be designated as the blade of the shovel portion. This shovel portion also includes integrated side walls 17 and top wall 17' over covering substantially all of the base, forming a closed area that is open in the front and back. This enclosed area constricts to a tubular zone 29 formed of extension 27 and which has a circular opening therein defined as a throat 26 for delivery of residue. Disposed rearwardly of the tubular section 29 and integrally connected thereto is a preferably curved tongue 25 which fits into the depth of the opening 36 of the container portion 12 to deliver residues and waste products into container portion 12. It is also to be noted, that the side walls 17 and top wall 17', extend only slightly inwardly into the tubular section 14 of the container portion 12, in order to inhibit the flow of dust that might arise if there were a gap between the shovel portion and the container portion when the shovel portion is disposed onto and utilized with the container portion.

Handle 22 maybe mounted on either one or both one or both sides of the container portion 12. This handle is used for carrying of the container once it has been filled partially or totally with residue materials.

On the other hand, handle 20 disposed at the intersection of the foot 18 with the tubular portion 14, is used to tilt the tubular portion toward the residue material when the shovel portion 11 is nestably mounted onto the container portion 12.

Figure 5:
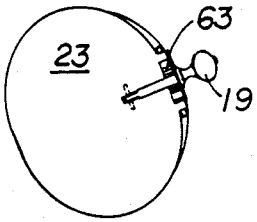
FIG. 5 is a perspective view of a portion of the invention.
Figure 8:
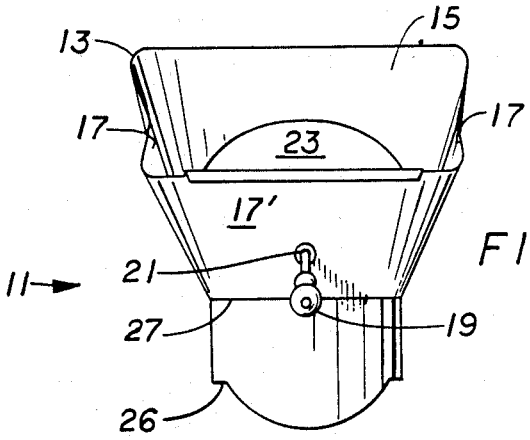
FIG. 8 is an elevational view of one portion of this invention.

Mounted preferably through the top wall 17' is flapper handle 19. It is disposed within a bore 21 and said handle is connected on its distal end to a flapper 23 best seen in FIGS. 5, 8. The hinged flapper 23 (the hinges thereof being designated 63) is sized to cover the throat 26 (seen in FIG. 3) of the shovel portion 11. The throat portion 26 constitutes the opening within the slight rear extension shown in FIG. 3 that is circular in cross section and fits into the opening of the tubular portion 14, of the container portion 12. Reference is also made to FIG. 8. This slight extension tubular portion designated 29, is seen to not only fit into the tubular portion 14 as previously disclosed, but constitutes a base to receive the flapper such that the flapper when in the closed position will prevent the discharge of residue materials from the shovel portion 11 into the container portion 12. Thus this extension 29 acts in the nature of a collar to provide a circular opening which can be readily closed by said flapper 23.

Mounted to the underside of base or blade 15 at the rear is a shocker 40, which serves as a pivotally mounted handle means. While shown in FIG. 3, this element of the invention is seen best in exploded fashion per FIG. 6. The shocker when operated serves to vibrate the shovel portion 11 such that when the flapper is in the open position i.e. The handle 19 is arcuately moved toward the operator, material within the shovel portion 11 will be urged rearwardly for disposition into the container portion 12.

Figure 6:
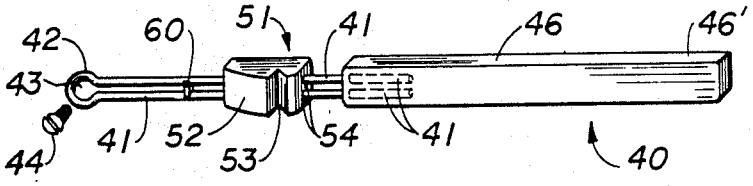
FIG. 6 is a partially exploded perspective view of the portion of the invention shown in FIG. 1.

Turning to FIG. 6, there is shown a closeup view of the shocker previously mention. The shocker 40 comprises a connecting rod arm 41, having a bent rod like portion 41' and an arcuate leading rod like portion 42, curved to and sized to receive bolt 44 integral therewith. The connecting arm 41 includes an opening in its arcuate bend 42, namely opening 43 through which is mounted a pivot bolt 44 for ultimate disposition into the rear of the base distant from the blade edge of base 15 of the shovel aforesaid. By using a pivot bolt, such is as well known in the art, the shocker 40 can be oriented to any appropriate angle. The elongated arm 41 includes a tongue portion 41'' of two parallel rod segments extending from 41' for disposition within a pair of recesses 47 of a wooden or other insulate material elongated body 46. The slider 51 can be moved reciprocally on the rails (rod) 41 with a thud thereby causing a vibration whereby agglomerated material or residues within the shovel portion will be loosened from contact with the interior surface of the shovel portion. Slider 51 comprises a dual bored member 52 with a V-channel horizontal recess 53. the parallel bores designated 54 receive the segments of rod 41'. Preferably the fit of the segments 41 & 41' is loose to permit easy reciprocal movement of slider 51. A portion of segments 41', designated 41'' are disposed and secured as by friction or adhesive into parallel bores 47 in handle 46.

Figure 7:
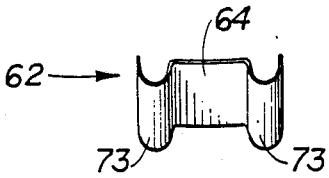
FIG. 7 is a top perspective view of one element shown in FIG. 2.

Seen in FIGS. 1 and 7 is a holder 62 for the lower end 46' of handle 46 holder 62 includes two spaced forward depending parallel portions 63 and a larger recessed central flat portion 64. Portion 64 is sized to receive the width of the handle 46 to retain it in place during periods of non use. Being elongated there is some resiliency to shocker 40. By pulling the shocker 40 away from portion 14 it can be made to clear the forwardly depending portion 65, such that upon release, the handle 46 will rest within recess 64.

Stop 60 mounted between or beneath rods 41 limits movement of the slider 51.

Figure 4:
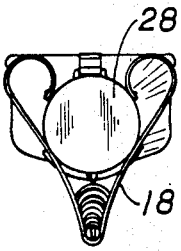
FIG. 4 is a bottom plan view.

Turning back to FIGS. 1, 2, 3 and 8, discussion now turns to the container portion 12 which includes a tubular section 14 as mentioned previously which is open at one end namely 16, and closed at the other end by end cap 28. Reference is made to FIG. 4. The tubular section 14 is tapered slightly larger in cross section than the tubular zone 29 of shovel portion 11, such as to be able to preferably frictionally, receive the tubular zone 29. A generally heart shaped foot 18, formed preferably from bar steel stock, is welded or otherwise secured to the end cap 28 and is again best seen in FIG. 4. Disposed at the convergent or tip of the heart is an upstanding cleat 18'. This cleat may be in the shape of a rod or ball as may be desired. A removably mounted handle 20 is secured to said foot and said tubular section.

The handle 20 comprises a helical section 30, open at one end, and of a diameter slightly greater than the cleat 18' such as to be able to receive said cleat within the confines of the helical section. The cleat as can be seen is disposed distant from said tubular section, to reduce the possibility of heat transfer. The handle 18 further includes an elongated bar or rod 31 which is disposed parallel to and adjacent tubular section 14, and an arcuate rod 32, mounted normal to said elongated rod at the top end thereof. Elongated bar 31 is seen also to include an outwardly diverging section 34 near the bottom end thereof, which section is disposed relative to the tubular section 14, substantially near the bottom thereof. This section 34, extends away from tubular portion 14 and into the helical part 30 through the top opening 30' and out the bottom opening thereof 30''. The helical part 30 is adapted for removable disposition on top of said cleat 18', while the tip of divergent section 34 of elongated rod 31 nests within the curvature of said cleat which is defined as a slightly arcuate segment of flat stock, mounted to depend upwardly from the surface of the foot 18.

A pair of spaced spring clips 33 are disposed outwardly from the body tubular section 14, and spaced to permit the insertion of handle 20's arcuate section 32 there beneath whereby when the opening 30' in the helical section 30 is disposed upon said cleat, 18' the device 10 can be readily transported.

Figure 9:
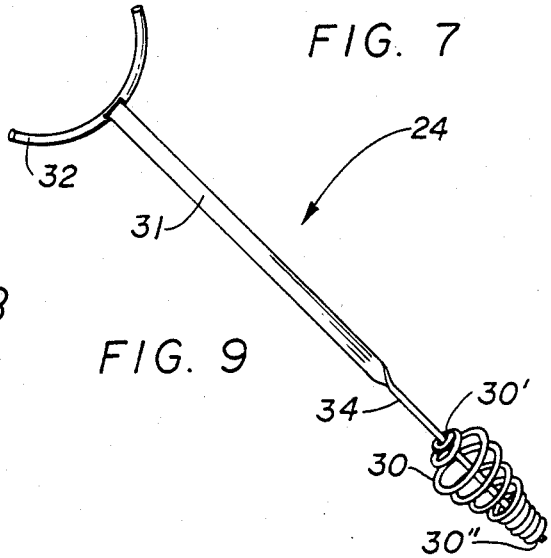
FIG. 9 is a perspective view of another element of this invention.

As can be seen, the handle when removed, can be employed as a poker for dismembering large pieces of residue, said poker being designated 24. See FIG. 9.

It is seen therefore that the handle designated 20, serves as a handle for the device 10, and said handle constitutes also a handle for the poker 24 which is disposed for convenient use upon the device of this invention.

A second or upper handle 22 may be disposed on one or both sides of the tubular section 14, to aid in the transportation and in the utilization of said container portion. This is beneficial, in view of the fact that the size and weight distribution of the tubular section, especially when filled with residue material could render use of the device difficult if said upper handle(s) were not present.

It is seen that the device of this invention comprises a shovel portion which can be utilized separately, or integrated as may be desired. The presence of the tongue 25 permits the shovel portion to easily nest into the tubular section of the invention. It also helps to guide the ashes into the tubular section. The flapper, when closed, after the collected residue has been disposed within the tubular section 14 can be closed both to help extinguish any embers that remain aglow, as well as to prevent the exodus of any odor into the surrounding room from smoke or embers that may be burning within the tubular section.

For safety sake, it is preferred that when hot embers are disposed within the container section, that to avoid damage to nylon or wool carpet, that the foot be disposed only upon the hearth which is usually made of an insulated material such as brick or stone.

To recapitulate on the benefit of the shocker, the shocker is employed both as a long insulated handle for the shovel portion and by being pivotally mounted, the shovel can be inserted to the furthest nook and cranny of the fireplace to obtain residues for disposition. The vibratory action of the shocker helps ease the ashes and other debris from the shovel into the container section. This vibratory action is created when the slider 51 is reciprocated and impacted on handle 46. Device 10 may be used laterally to gather ashes and tipped to a 45 degree angle for disposition of the ashes into tube 14. This can be achieved in two ways. One is by manual movement of the slider 51 itself, which may be difficult in view of the inverted position of the slider beneath the shovel portion.

The preferred mode is to engage the frame or lip of the bottom of the door opening of a stove, or the frame bottom opening for a fireplace screen within the V groove 53 of the device. In this instance one reciprocates handle 46 such that the slider 51 impacts both stop 60 and the top surface of the handle.

In an open hearth fireplace, the first recited mode is the only one employable.

As to construction, any type of suitable sheet metal such as aluminum or galvanized iron which may be left in the unpainted state or painted with a heat resistant black paint, may be employed for the shovel end tubular section. Wrought iron may be utilized for the foot as well as for the elongated and arcuate rods of the poker, The helical portion of the handle (poker) is made of a spring steel or other suitable material. By having minimum contact with the divergent rod section, heat transfer is minimized. It is for this same reason that the shocker handle should be made of wood or other non-heat sensitive material. As to the flapper there also sheet metal may be employed, and an appropriate insulator such as a ceramic bead may be employed at the exterior end of the flapper handle 19 to again minimize heat transfer to the operator.

It is seen that the device of this invention can be employed within the household, by persons from ages 10 to 100, for the easy maintenance of a fireplace or Franklin stove. The device itself maybe maintained in a reasonably clean condition on the exterior thereby permitting it to be stowed next to the fireplace or Franklin stove in one's household.

It is seen that I have provided a tool that is useful for the removal of residues from a fireplace which residues maybe removed whether they are in a warm or cool condition. My device also provides temporary storage means, such that these residues can be immediately collected at point of necessity such that the fire place can continue to be enjoyed, without an intermittent period of time while the user waits for the fire to cool down or be extinguished prior to the collection of ashes and other residues. It is significantly better than the only other patent device known to me, namely that of the Burke Pat. No. 2,637,588.

While spring clips mounted on the tubular section are disclosed to hold the detachable poker, simple outwardly then downwardly bent tabs will also suffice for this purpose.

Since the device of this invention has a very small foot print, it can be readily stored by the hearth or adjacent to the fireplace as may be desired.

It is seen that I have provided a device that is both physically attractive as well as easy to use.

While the device of this invention can be made to have the shovel portion removable from the container portion, by frictional disengagement, the two portions can be welded together to form a unit structure if desired.

It is to be noted that it may be easier to separate the storage portion from the shovel portion by standing on the two feet of the storage portion, prior to pulling the shovel portion upward.

Since certain changes may be made in the above apparatus without departing from the scope of the invention herein involved, it is intended that all matter contrary to the above description shall be interpreted as illustrative and not in a limiting sense.

This metal part can be replaced by temperature resistant plastic parts. Obviously other collection and disposition uses may be had for the instant device within the realm of skill of the homeowner, farmer and merchant.

What is claimed is:

1. A device for the collection and temporary storage of residues from a fireplace comprising:

a. a shovel portion and b. a container portion wherein the shovel portion comprises a scoop shovel body having a generally flat base and spaced rearwardly from the front edge of said base, an integrated top and side walls that cover a major portion of said base, said shovel being open at the front and back thereof, the enclosed area constricting to a tubular zone defining a throat for delivery of residue material to a container, disposed rearwardly of said base is a tongue adapted to fit within said container portion, and a handle means on the shovel portion comprising a reciprocal moving shocker to urge captured materials rearwardly;

and wherein said container portion comprises;

a tubular section, open at one end, and closed off at the other end by an end cap, said tubular section, having a cross section adapted to receive the tubular zone of said shovel portion;

a foot secured at said end cap transverse to the length of the tubular section to provide vertical stability to said device.

2. The device of claim 1 wherein the shovel portion also includes a manually operable pivotally mounted flapper adapted to close off said throat upon being moved from a first open position to a second closed position.

3. The device of claim 2 wherein the shovel portion is in frictional engagement with the container portion.

4. The device of claim 1 wherein the shocker comprises a pivotally mounted connecting arm to which is secured a means for inducing a vibration in said arm for flow of said vibration into said shovel portion.

5. The device of claim 1 further including a detachable poker removably secured to said container portion.

6. The device of claim 1 including means for securing a detachable poker to said tubular section and said foot.

7. The device of claim 6 wherein the means for securing the poker disposed upon the tubular section comprises a pair of spring clips, while the means on said foot is an upstanding cleat.

8. The device of claim 6 including a detachable poker, wherein the detachable poker comprises an elongated rod having an arcuate rod normal thereto at one end, and a handle at the opposite end.

9. The device of claim 2 including a detachable poker, wherein the detachable poker comprises an elongated rod having an arcuate rod normal thereto at one end, and a handle at the opposite end.

10. The device of claim 1 wherein a handle is fixedly mounted on the tubular section of the container portion.

11. A device for the collection and temporary storage of residues from a fireplace comprising:

a. a shovel portion and b. a container portion wherein the shovel portion comprises a scoop shovel body having a generally flat base and spaced rearwardly from the front edge of said base, an integrated top and side walls that cover a major portion of said base, said shovel being open at the front and back thereof, the enclosed area constricting to a tubular zone defining a throat for delivery of residue material to a container, disposed rearwardly of said base is a tongue adapted to fit within said container portion, and a pivoting handle on the shovel portion, said shovel portion being removably secured to said container portion, and wherein said container portion comprises:

a tubular section, open at one end, and closed off at the other end by an end cap, said tubular section, having a cross section adapted to receive the tubular zone of said shovel portion;

a foot secured at said end cap transverse to the length of the tubular section to provide vertical stability to said device.

12. The device of claim 11 including a detachable poker rearwardly secured to said container portion.

13. The device of claim 12 wherein said shovel portion's handle further includes a shocker.

14. The device of claim 11 wherein the shovel portion nestingly engages the container portion by a tapered frictional engagement.

15. In the device of claim 11, wherein a handle is fixedly mounted upon said tubular section of said container portion.

* * * * *